United States Patent [19]

Shin

[11] Patent Number: 4,664,157

[45] Date of Patent: May 12, 1987

[54] INCOMPLETE WEFT REMOVING DEVICE FOR SHUTTLELESS LOOM

[75] Inventor: Tokujirou Shin, Matsuto, Japan

[73] Assignee: Tsukakoma Corp., Ishikawa, Japan

[21] Appl. No.: 816,516

[22] Filed: Jan. 6, 1986

[30] Foreign Application Priority Data

Jan. 9, 1985 [JP] Japan ..... 60-1728
Jan. 9, 1985 [JP] Japan ..... 60-1191[U]

[51] Int. Cl.[4] ..... D03D 47/30
[52] U.S. Cl. ..... 139/116; 139/435
[58] Field of Search ..... 139/1 R, 1 E, 116, 429, 139/435, 370.2, 452

[56] References Cited

U.S. PATENT DOCUMENTS 3,805,850 4/1974 Duynhoven et al. ..... 139/116
4,502,512 3/1985 Suzuki et al. ..... 139/116
4,503,889 3/1985 van Mullekom .
4,503,891 3/1985 Novak et al. ..... 139/116
4,559,976 12/1985 Araki et al. ..... 139/116

FOREIGN PATENT DOCUMENTS 2090294 7/1982 United Kingdom ..... 139/435

*Primary Examiner*—Henry S. Jaudon
*Attorney, Agent, or Firm*—Flynn, Thiel, Boutell & Tanis

[57] ABSTRACT

An incomplete weft removing device comprising a pair of winding members disposed in a space between the picking nozzle of a loom and the selvage of a woven cloth on the loom, and supported so as to be rotatable and to be joined to or separated from each other, driving means for axially moving a pair of the winding members so that a pair of the winding members are engaged or disengaged, a rotative driving means for rotating a pair of the winding members at the time of being pressed against each other and a cutter disposed between the picking nozzle and a pair of the winding members for cutting an incomplete weft.

4 Claims, 8 Drawing Figures

INCOMPLETE WEFT REMOVING DEVICE FOR SHUTTLELESS LOOM

BACKGROUND OF THE INVENTION

1. Field of the Invention

The present invention relates to an incomplete weft removing device for removing an incompletely inserted weft from the cloth fell on a shuttleless loom.

2. Description of the Prior Art

The shuttleless loom is equipped with a weft stop motion and, when an incomplete weft is detected, the weft stop motion stops the shuttleless loom automatically. After the shuttleless loom has been thus stopped, the incomplete weft must be removed while the shuttleless loom is stopped.

Japanese Utility Model Publication No. 56-17503 discloses means for removing an incomplete weft. Conventional well-known means for removing an incomplete weft, including the means disclosed in the above-mentioned Japanese Utility Model Publication, are designed to extract an incomplete weft from the cloth fell with a hook or the like before the incomplete weft is cut off after the picking nozzle. Therefore, when the incomplete weft is hooked and pulled warpwise with the hook, the pulling force is transmitted through the incomplete portion of the weft to the following portion of the same extending behind the picking nozzle, and thereby the following portion of the weft to be inserted at the next pick is disturbed. Furthermore, since it is difficult to secure sufficient space for moving the hook warpwise, such conventional means are not applicable to looms without distinction of the type of looms.

Japanese Unexamined Patent Publication (Kokai) No. 59-21757 discloses another incomplete weft removing device as illustrated in FIG. 7, in which part of an incomplete weft is brought to a waste roller by a jet of air, and then, the incomplete weft is wound off the cloth fell with the waste roller. This technique, however, is unable to bring part of an incomplete weft surely to the waste roller, incapable of automatically discharging the waste weft after the same has been wound off the cloth fell and, since the waste roller draws the weft from the picking nozzle as the same winds up the incomplete weft, incapable of removing the incomplete weft without wasting other portions of the weft. Thus, this prior art also has many problems to be solved to achieve the automatic removal of an incomplete weft.

SUMMARY OF THE INVENTION

Accordingly, it is an object of the present invention to provide an incomplete weft removing device capable of extracting an incomplete weft without effecting the following portion of the weft extending behind the picking nozzle, capable of surely extracting an incomplete weft at a fixed position without pulling the incomplete weft warpwise away from the cloth fell as in the conventional device, and capable of automatically discharging the extracted incomplete weft, namely the waste weft.

According to the present invention, upon the interruption of the weaving operation of the loom due to weft stop, an incomplete weft is held between a pair of winding members at a portion between the picking nozzle and the adjacent selvage, then the incomplete weft is cut off from the following portion of the weft, and then the incomplete weft is extracted from the cloth fell by being wound up on the pair of the winding members. Thus, the incomplete weft removing operation is carried out surely in a narrow space and the extracted incomplete weft can be automatically discharged.

In a preferred embodiment of the present invention, the pair of the winding members are located at a position between the picking nozzle and the adjacent selvage and apart from the center axis of the picking nozzle toward the reed so that they will not obstruct the picking operation.

Accordingly, in a preferred embodiment, the pair of the winding members are supported on a support arm so as to be shifted from a retracted position to an operating position, namely, a position where the winding members are able to wind an incomplete weft, to hold the incomplete weft therebetween. In another embodiment, an incomplete weft is brought to a pair of the winding members with the swingable guide arm, and then the pair of the winding members wind up the incomplete weft.

However, the pair of the winding members will not obstruct the picking operation even if they are disposed close to the extension of the center axis of the picking nozzle, provided that the winding members are separated from each other while they are not functioning. Accordingly, a pair of winding members may be disposed close to the extension of the center axis of the picking nozzle.

The pair of the winding members holds one end of an incomplete weft, and then rotate to extract the incomplete weft from the cloth fell by winding up the same thereon. When the pair of the winding members rotate, the incomplete weft is pulled diagonally away from the cloth fell. Therefore, the incomplete weft need not be separated from the cloth fell by a separate device prior to extraction. After the incomplete weft has been wound up on the pair of the winding members, the winding members are separated from each other, whereby the extracted incomplete weft can be easily thrown away The present invention has the following effects.

First, since an incomplete weft is separated from the following portion of the weft extending behind the picking nozzle prior to extraction of the incomplete weft, the following portion of the weft is not drawn out through the picking nozzle and is not disturbed.

Secondly, since the pair of the winding members are joined together for extracting an incomplete weft and are separated from each other for discharging the extracted incomplete weft, the incomplete weft is gripped and discharged surely.

Thirdly, since a pair of the winding members are disposed at a position corresponding to the nose of the picking nozzle or are disposed at a retracted position and shifted to an operating position for operation, any guide arm for drawing an incomplete weft near to the winding members need not be provided, and hence the device is simple in construction and is capable of being disposed within a narrow space.

The above and other objects, features and advantages of the present invention will become more apparent from the following description of the preferred embodiments thereof taken in conjunction with the accompanying drawings.

DESCRIPTION OF THE PREFERRED EMBODIMENTS

Embodiment 1

Figure 1:
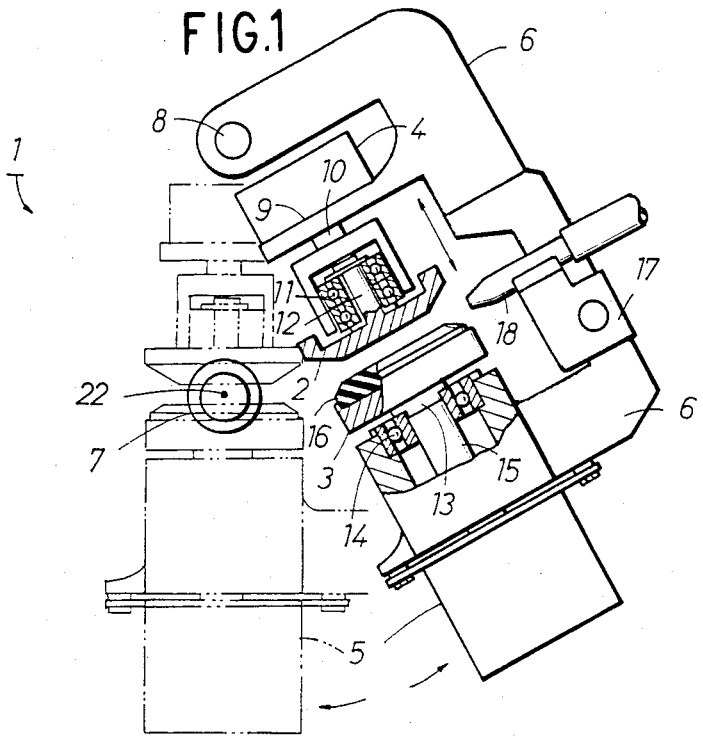
FIG. 1 is partly cutaway front elevation of an incomplete weft removing device, in a preferred embodiment, according to the present invention.

FIGS. 1 to 4 illustrate an incomplete weft removing device 1, in a first embodiment, according to the present invention. The principal part of the incomplete weft removing device 1 includes a pair of winding members 2 and 3, driving means, such as an electromagnetic plunger 4, for engaging or disengaging the winding members 2 and 3, and rotative driving means, such as a motor 5, for rotating a pair of the winding members 2 and 3.

A pair of the winding members 2 and 3 are supported directly or indirectly on a support arm 6 opposite to each other. The support arm 6 is supported pivotally at the upper end thereof on a shaft 8 disposed above and extending parallel to the center axis of a picking nozzle 7.

The electromagnetic plunger 4 is attached to the suport arm 6 by means of a bracket 9. A bearing housing is provided at the free end of a movable rod 10 of the electromagnetic plunger 4. A shaft 12 of the winding member 2 is supported in bearings 11 fitted in the bearing housing so that the winding member 2 is rotatable. The movable rod 10 of the electromagnetic plunger 4 is restrained from rotation. Normally, the movable rod 10 is retracted by an internal spring or the like. When the electromagnetic plunger 4 is actuated, the movable rod 10 is projected to press the winding member 2 against the winding member 3.

A shaft 13 of the winding member 3 is supported for rotation in a bearing 14 held on the bearing part of the suport arm 6. The motor 5 is mounted on the support arm 6 so that an output shaft 15 thereof is aligned with the shaft 13 of the winding member 3. The output shaft 15 is coupled with the shaft 13 of the winding member 3. Both of the winding members 2 and 3 have the shape of a frustum of a right circular cone. At least one of the winding member 2 and the winding member 3, the winding member 3 in this embodiment, includes a surface facing the other winding member an elastic pad 16, such as a rubber pad.

A discharging nozzle 18 is fixedly held on the support arm 6 with a holding member 17 with the center axis thereof directed toward the middle of the winding members 2 and 3. A cutting blade 20 is fixed to the support arm 6 so as to be able to cooperate with a cutting blade 19 disposed near the picking nozzle 7 when the support arm 6 is moved to the operating position.

Figure 2:
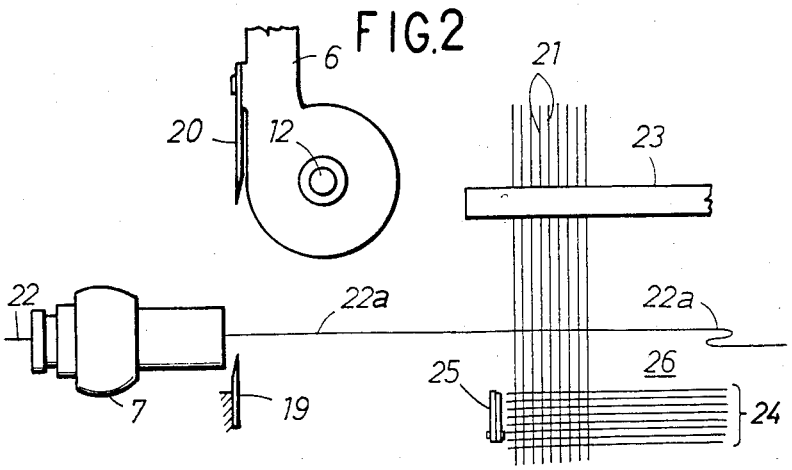
FIG. 2 is a plan view showing the position of the incomplete weft removing device of FIG. 1 relative to the associated device.

As illustrated in FIG. 2, the winding members 2 and 3 are disposed between the picking nozzle 7 and an outermost warp 21. A weft 22 is picked into a shed between the warps 21 by the picking nozzle 7, and then is beaten up by a reed 23 into a woven cloth 24.

The functions and manner of operation of the incomplete weft removing device of the present invention will be described hereinafter.

The picking nozzle 7 draws out the weft 22 from a yarn package and inserts the same into a shed between the warps 21. Then, the reed 23 beats up the inserted weft 22 into the woven cloth 24. After the weft 22 has been inserted completely, the weft 22 is cut at a position near the selvage of the picking side with a cutter 25. As illustrated by continuous lines in FIG. 1, the support arm 6 is retracted to the retracted position and the winding members 2 and 3 are separated from each other during the normal weaving operation.

Upon the detection of an incomplete weft insertion, the cutter 25 is held inoperative, the next picking operation is stopped and the loom is stopped automatically. Then, the main shaft of the loom is reversed to a phase where a cloth fell 26 is opened so that an incomplete weft 22*a* can be easily extracted. In this state, the incomplete weft 22*a* extends between the picking nozzle 7 and the woven cloth 24 without being cut and waits for an incomplete weft removing operation.

Then, the support arm 6 is turned clockwise, as viewed in FIG. 1, to locate the winding members 2 and 3 in front of the nose of the picking nozzle 7 near the extension of the center axis of the same so that the winding members 2 and 3 are positioned on opposite sides of the incomplete weft 22*a*, respectively. The shaft 8 is turned to turn the support arm 6 by a combined mechanism of a rotary actuator or a pneumatic cylinder, and a crank mechanism.

Then, the electromagnetic plunger 4 is actuated to project the movable shaft 10 so as to press the winding member 2 against the winding member 3 so that the incomplete weft 22*a* is gripped between the front surface of the winding member 2 and the elastic pad 16 attached to the winding member 3. After the incomplete weft 22*a* has been gripped by the pair of the winding members 2 and 3, the support arm 6 is turned slightly to cut the incomplete weft 22*a* from the following portion of the weft 22 to be inserted in the next pick with the cutting blades 19 and 20. Accordingly, the following portion of the weft 22 is not drawn out forcibly as the incomplete weft 22*a* is extracted, and hence stable picking operation is possible after the extraction of the incomplete weft 22*a*.

Figure 3:
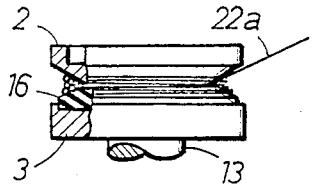
FIG. 3 is a partly cutaway side elevation of the winding members of the incomplete weft removing device of FIG. 1 in an operating position.

After the incomplete weft 22*a* has been cut off from the following portion of the weft 22, the motor 5 is actuated to rotatively drive the winding member 3. Since the winding members 2 and 3 rotate in a unit, the incomplete weft 22*a* is wound around a groove formed by the outer circumferences of the winding members 2 and 3 as illustrated in FIG. 3. Thus, the incomplete weft 22*a* is extracted from the cloth fell 26.

Figure 4:
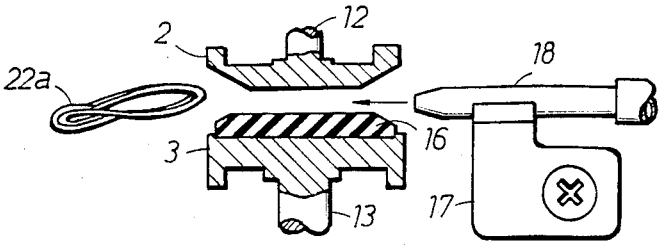
FIG. 4 is a fragmentary sectional view showing the manner of discharging the extracted and wound incomplete weft.
Figure 5:
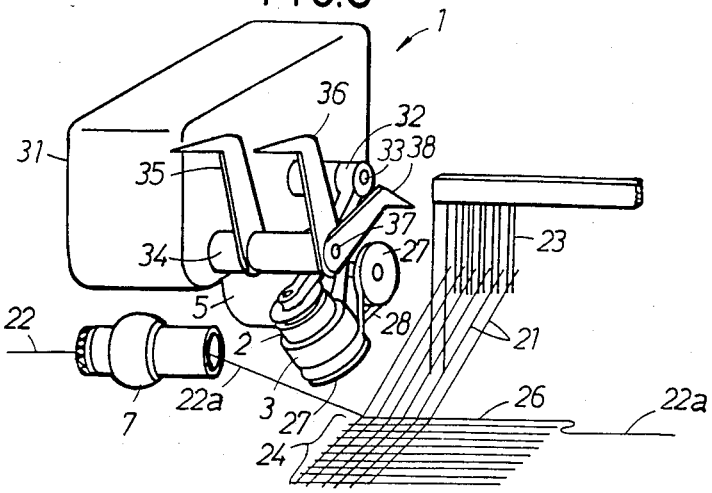
FIG. 5 is a perspective view of an incomplete weft removing device, in another embodiment, according to the present invention.

Upon the completion of winding the entire length of the incomplete weft 22*a* around the outer circumferences of the winding members 2 and 3, the plunger 4 retracts the shaft 12 to separate the winding member 2 from the winding member 3, as illustrated in FIG. 4. Then, the discharging nozzle 18 jets a stream of air or water to blow the coils of the extracted incomplete weft 22*a* from the elastic pad 16 toward a predetermined position. After the extracted incomplete weft 22*a* has thus been discharged, the support arm 6 is turned counterclockwise to return the winding members 2 and 3 to the retracted position, where the winding members 2 and 3 are kept waiting for the next incomplete weft removing operation.

As described hereinbefore, since the entire process of incomplete weft removing operation is carried out automatically, the loom can be restarted immediately after the completion of the incomplete weft removing operation.

In this embodiment, the pair of the winding members 2 and 3 are moved between the retracted position and the predetermined operating position by swinging the support arm 6, however, it is also possible to move the winding members 2 and 3 between the retracted position and the operating position by translating the support arm 6 linearly. Furthermore, a pair of the winding members 2 and 3 may be disposed previously at fixed positions, with a gap therebetween, on opposite sides of the extension of the center axis of the picking nozzle 7, so that the winding members 2 and 3 will not interfer with the picking operation. In this embodiment, the winding member 2 is axially movable, however, the other winding member 3 may be movable instead of the winding member 2. Furthermore, the electromagnetic plunger 4 is employed in this embodiment as the means for axially moving the winding member 2, however, a pneumatic plunger may be employed instead of the electromagnetic plunger 4 for the same purpose.

As mentioned above, the incomplete weft winding operation is carried out on the extension of the center axis of the picking nozzle 7, however, it is more advantageous to carry out the incomplete weft winding operation after retracting the support arm 6 to the retracted position, because the incomplete weft 22*a* is pulled diagonally away from the cloth fell 26 so as to be separated from the cloth fell as the same is extracted, when the winding operation is carried out after the support arm 6 has been retracted to the retracted position, and hence the incomplete weft 22*a* can be extracted by a smaller force without damaging the warps 21.

Embodiment 2

FIGS. 5 to 8 illustrate an incomplete weft removing device 1, in a second embodiment, according to the present invention.

The principal part of the incomplete weft removing device 1 includes, similarly to that of the first embodiment, a pair of winding members 2 and 3 having the shape of a frustum of a right circular cone. The shaft 13 of the winding member 3 is supported rotatably in ball bearings 14 on a bracket 29 at a suitable inclination. The winding member 3 is driven for rotation by a motor 5 through pulleys 27 fixed to the shaft 13 and the output shaft of the motor 5 as a rotative driving means, and through a belt 28 extended between the pulleys 27, during extracting of an incomplete weft. The bracket 29 is attached together with a holding member 17 to the side surface of a main case 31 with a bolt 30.

The shaft 12 of the other winding member 2 is supported rotatably in ball bearings 11 on a swing arm 32 so as to be positioned opposite to the winding member 3. The swing arm 32 moves the winding member 2 toward or away from the winding member 3. The swing arm 32 is supported at the base end thereof on a shaft 33 mounted on the main case 31 for turning in opposite directions.

On the other hand, a pair of guide arms 35 and 36 are attached to a hollow shaft 34 mounted on the main case 31 for swing motion, while an auxiliary arm 38 is attached to a shaft 37 received coaxially through the hollow shaft 34 for swing motion. A rotative driving mechanism for rotatively driving the shafts 34 and 37 is accomodated in the main case 31. A pair of the guide arms 35 and 36 is designed so as to hold a weft 22 therebetween at a position between a pair of the winding members 2 and 3, when the guide arms 35 and 36 are turned. The auxiliary arm 38 is positioned beside the side surface of the guide arm 36. The guide arm 35 is disposed opposite a cutter blade 39 attached to the side wall of the bracket 29.

The main case 31 is disposed above a picking nozzle 7. In this state, the winding members 2 and 3 are located on one side of the picking nozzle 7 and between the picking nozzle 7 and the selvage of the woven cloth 24 on the loom.

A series of operations of the incomplete weft removing device 1 will be described hereinafter.

Upon the detection of incomplete weft insertion, the cutter 25 is held inoperative, the next picking operation is stopped and the loom is stopped automatically. Then, the main shaft of the loom is reversed to a phase where the cloth fell 26 is opened so that an incomplete weft 22*a* can be easily extracted. In this state, the incomplete weft 22*a* is extended between the picking nozzle 7 and the woven cloth 24 without being cut and waits for an incomplete weft removing operation.

Figure 6:
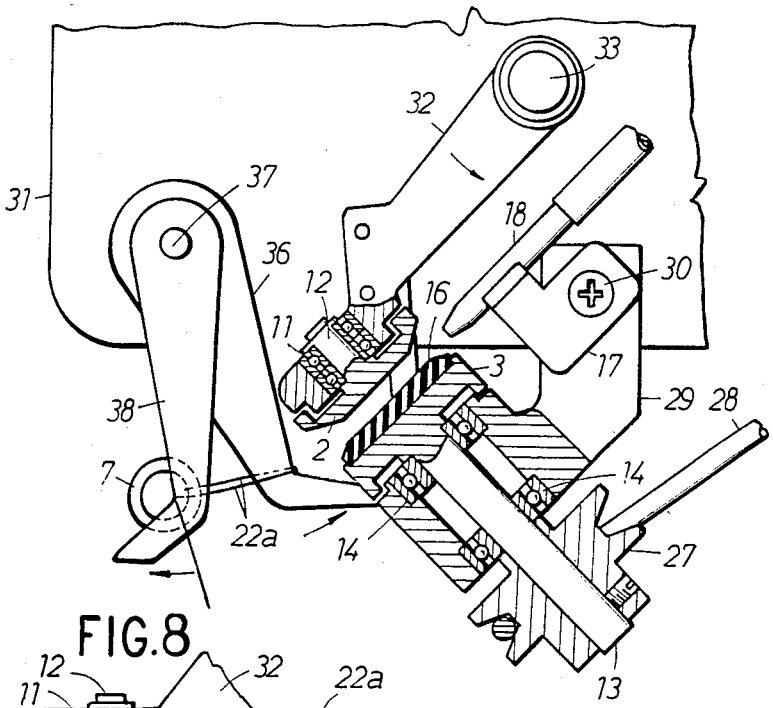
FIG. 6 is an enlarged sectional front elevation of the incomplete weft removing device of FIG. 5.
Figure 8:
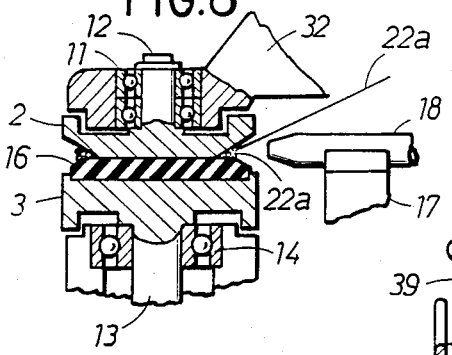
FIG. 8 is a sectional view of a pair of winding members of the device of FIG. 5 in an operating position for extracting an incomplete weft.
Figure 7:
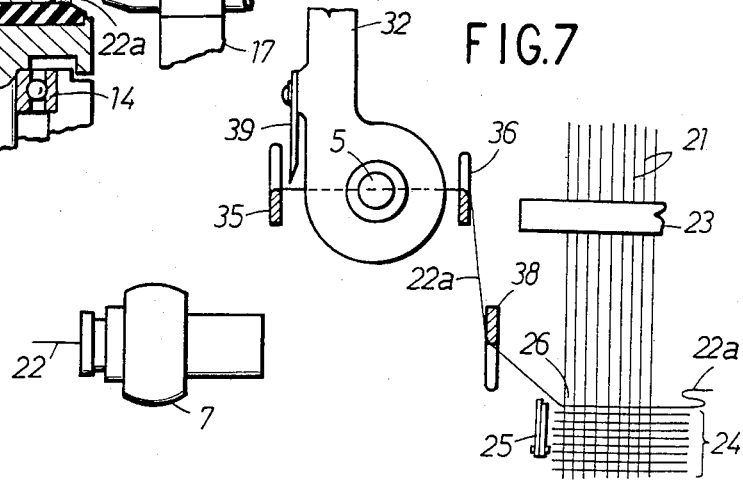
FIG. 7 is a plan view of the essential portion of the incomplete weft removing device of FIG. 5.

Then, as illustrated in FIGS. 6 and 7, the auxiliary arm 38 is turned clockwise to hold the incomplete weft 22*a* at a position slightly behind the extension of the cloth fell 26, and then a pair of the guide arms 35 and 36 are turned counterclockwise to catch the incomplete weft 22*a* at a portion between the auxiliary arm 38 and the picking nozzle 7 and to move the portion of the incomplete weft 22*a* to a position between the pair of the winding members 2 and 3 as illustrated in FIGS. 6 and 7. Since the winding members 2 and 3 are separated from each other, the incomplete weft 22*a* is received between the winding members 2 and 3.

Then, the shaft 33 turns counterclockwise, as viewed in FIG. 6, to press the winding member 2 supported on the free end of the swing arm 32 against the elastic pad 16 of the winding member 3 so that the incomplete weft 22*a* guided between the winding members 2 and 3 is gripped between the winding members 2 and 3. After the incomplete weft 22*a* has been gripped between the winding members 2 and 3, a pair of the guide arms 35 and 36 are turned further to cut the incomplete weft 22*a* at a position between the guide arm 35 and a pair of the winding members 2 and 3 with the cutting blade 39. Thus, the incomplete weft 22*a* is cut off from the following portion of the weft 22 which is to be inserted by the next picking operation.

Then, the motor 5 rotates the shaft 13 through the pulleys 27 and the belt 28 to rotate the winding members 2 and 3 which are pressed against each other. When the winding members 2 and 3 are rotated, the incomplete weft 22*a* is wound up around a V-shaped groove formed by the outer surfaces of the winding members 2 and 3, and thereby the same is extracted from the cloth fell 26. Upon winding up the entire length of the incomplete weft 22*a*, the rotation of the winding members 2 and 3 are interrupted and the winding members 2 and 3 are separated from each other. Then, the discharge nozzle jets a stream of air or water to blow off the coils of the extracted incomplete weft 22*a* toward a predetermined direction. Then, the guide arms 35 and 36 and the auxiliary arm 38 are returned to the respective predetermined waiting positions to complete the incomplete weft removing operation. This series of sequential operations is controlled by a sequential control circuit. After the incomplete weft 22*a* has thus been removed, the loom is reset automatically for the succeeding weaving operation.

The guide arms 35 and 36 employed in the second embodiment are supported swingably for the purpose of guiding the incomplete weft 22*a* to a position between the pair of the winding members 2 and 3. Therefore, when either the guide arm 35 or 36, the guide arm 35, for instance, is capable of guiding the incomplete weft 22*a* to a predetermined position, the other guide arm, the guide arm 36, for instance, may be omitted.

Furthermore, in the second embodiment, the winding member 2 is movable, while the winding member 3 is driven for rotation, however, it is also possible to interchange such functions between the winding members 2 and 3 or to make movable and to drive for rotation both the winding members 2 and 3.

Although the invention has been described in its preferred form with a certain degree of particularity, it is to be understood that many changes and variations are possible in the invention without departing from the scope and spirit thereof.

What is claimed is:

1. An incomplete weft removing device comprising:

a pair of winding members disposed in a space between a picking nozzle of a loom and the selvage of a woven cloth on the loom, and supported for rotation and for relative axial movement between positions engaging and separated from each other;

axial driving means for effecting relative axial movement of the winding members between said engaging and separated positions;

rotative driving means for rotating the winding members when the winding members are in said engaging position; and cutter means disposed between the picking nozzle and the winding members for cutting an incomplete weft;

wherein said winding members each have the shape of a frustum of a right circular cone, and said winding members are disposed with the respective upper bases of said frustums facing each other.

2. An incomplete weft removing device according to claim 1, wherein said winding members are supported for movement between a retracted position and an operating position, and including means for effecting movement of the winding members between said retracted and operating positions, wherein in said retracted and operating positions the winding members are respectively spaced from and disposed near a nose of the picking nozzle.

3. An incomplete weft removing device according to claim 1, wherein said axial driving means includes a plunger.

4. An incomplete weft removing device according to claim 1, wherein said winding members are disposed immovably on one side of the picking nozzle, and including guide arm means for catching an incomplete weft at a portion thereof extending between the picking nozzle and the selvage of the woven cloth and for guiding the incomplete weft to a position between the winding members.

* * * * *

UNITED STATES PATENT AND TRADEMARK OFFICE

CERTIFICATE OF CORRECTION

PATENT NO. : 4 664 157

DATED : May 12, 1987

INVENTOR(S) : Tokujirou SHIN

It is certified that error appears in the above-identified patent and that said Letters Patent is hereby corrected as shown below: Item [73]

On the title page, please change the Assignee from "Tsukakoma Corp." to ---Tsudakoma Corp.---.

Signed and Sealed this

Fifteenth Day of December, 1987

*Attest:*

DONALD J. QUIGG

*Attesting Officer*

*Commissioner of Patents and Trademarks*